US009488187B2

(12) United States Patent
Bardon et al.

(10) Patent No.: US 9,488,187 B2
(45) Date of Patent: Nov. 8, 2016

(54) SEAL ASSEMBLY FOR CENTRIFUGAL COMPRESSORS

(71) Applicant: DRESSER-RAND COMPANY, Olean, NY (US)

(72) Inventors: Patrice Bardon, Houston, TX (US); Raphael Bridon, Le Havre (FR); Wee Sen Ng, Houston, TX (US); William Runyan, Bradford, PA (US)

(73) Assignee: Dresser-Rand Company, Olean, NY (US)

( * ) Notice: Subject to any disclaimer, the term of this patent is extended or adjusted under 35 U.S.C. 154(b) by 95 days.

(21) Appl. No.: 14/172,490

(22) Filed: Feb. 4, 2014

(65) Prior Publication Data

US 2014/0225325 A1 Aug. 14, 2014

Related U.S. Application Data

(60) Provisional application No. 61/763,009, filed on Feb. 11, 2013.

(51) Int. Cl.
*F16J 15/38* (2006.01)
*F04D 29/12* (2006.01)

(52) U.S. Cl.
CPC ..... *F04D 29/12* (2013.01); *F04D 29/124* (2013.01)

(58) Field of Classification Search
CPC ..... F04D 29/12; F04D 29/124
See application file for complete search history.

(56) References Cited

U.S. PATENT DOCUMENTS

| | | | | |
|---|---|---|---|---|
| 4,189,156 | A * | 2/1980 | Geary et al. | 277/304 |
| 8,651,801 | B2 * | 2/2014 | Shamseldin et al. | 415/112 |
| 2013/0259679 | A1 * | 10/2013 | Brailean | F16J 15/008 415/230 |
| 2015/0330401 | A1 * | 11/2015 | Hashimoto | F04D 29/124 415/180 |

* cited by examiner

*Primary Examiner* — Kristina Fulton
*Assistant Examiner* — Thomas Neubauer

(57) ABSTRACT

A sealing system for process gas leakage from a turbomachine casing is provided. The sealing system may include a seal assembly housing coupled to or integral with the turbomachine casing. The seal assembly housing defines a bore configured to receive a rotary shaft and a sealing assembly. The sealing assembly includes a plurality of carbon rings mounted circumferentially about the rotary shaft. The plurality of carbon rings may include an inboard carbon ring configured to prevent flow of a separation gas inboard of the barrier seal, an outboard carbon ring configured to prevent flow of contaminates into the seal assembly housing, and an intermediate carbon ring interposed between the inboard carbon ring and outboard carbon ring. A pressure differential is maintained across the inboard carbon ring, such that the separation gas is prevented from flowing inboard across the inboard carbon ring by a residual portion of a seal gas.

13 Claims, 5 Drawing Sheets

SEAL ASSEMBLY FOR CENTRIFUGAL COMPRESSORS

CROSS REFERENCE TO RELATED APPLICATIONS

This application claims priority to U.S. Provisional Patent Application having Ser. No. 61/763,009, which was filed Feb. 11, 2013. This priority application is hereby incorporated by reference in its entirety into the present application to the extent consistent with the present application.

BACKGROUND

Centrifugal compressors in process gas service generally require rotary shaft sealing to prevent the process gas from escaping the compressor casing in an uncontrolled manner into the atmosphere. Typically, multi-stage "beam" style compressors require two seals, each disposed at an end of the rotary shaft, whereas single-stage, "overhung" style compressors require a single rotary shaft seal disposed directly behind the impeller. In the past, oil film seals were used in many applications to prevent the leakage of the process gas; however, the use of dry gas seals in place of oil film seals has increased dramatically in recent years.

Generally, dry gas seals function as mechanical face seals and include a mating (rotating) ring and a primary (stationary) ring. During operation, grooves in the mating ring generate a fluid-dynamic force causing the primary ring to separate from the mating ring creating a "running gap," typically 3-10 microns, between the two rings. A sealing gas may be injected into the dry gas seal, thereby providing the working fluid for the running gap of the dry gas seal, which forms a non-contacting seal between the atmosphere or flare system and the internal process gas of the compressor.

The sealing gas injected into the dry gas seal may be process gas fed from the discharge line of the centrifugal compressor. Typically, a portion of the sealing gas injected into the dry gas seal may be vented via a primary vent to the atmosphere or flare system. However, it is often desirable to return the sealing gas to the centrifugal compressor for processing, thereby improving efficiency. The foregoing may be accomplished via the redirection of the sealing gas flow through the primary vent to the suction side of the centrifugal compressor.

Generally, in centrifugal compressors, inboard (i.e., axially inward along the rotary shaft toward the centrifugal compressor) of the dry gas seal is an inner labyrinth seal, which separates the process gas from the dry gas seal, and outboard (i.e., axially outward along the rotary shaft away from the centrifugal compressor) of the dry gas seal is a barrier seal, which is typically provided proximate the end portion of the rotary shaft adjacent the shaft bearings to prevent the lubricant provided to the shaft bearings from contaminating the dry gas seal. A separation gas supply may be injected into the barrier seal to create a barrier to prevent the migration of lubricant, e.g., oil, into contact with the dry gas seal. Typically, an inert gas, such as nitrogen, or air may be utilized as the separation gas. In a conventional seal assembly, as a result of the injection of the inert gas into the barrier seal, a portion of the inert gas may leak across the barrier seal and may be routed through a secondary vent for removal from the centrifugal compressor.

In addition to the inert gas routed through the secondary vent, often a residual portion of the seal gas may bypass the primary vent, thereby being routed to the secondary vent for removal from the centrifugal compressor. Accordingly, a mixture of process gas and inert gas may be discharged from the secondary vent. It would be desirable to recycle this mixture to the suction side of the centrifugal compressor for further processing and improved efficiency. However, the inclusion of the inert gas in the secondary vent discharge may negatively impact the operation of the centrifugal compressor if fed therethrough.

What is needed, then, is a sealing assembly for a centrifugal compressor, such that inert gas from the separation gas supply is prohibited from entering the secondary vent. Such a sealing assembly provided would further be configured to substantially reduce or prevent the uncontrolled leakage of process gas into the atmosphere.

SUMMARY

Embodiments of the disclosure may provide a sealing assembly configured to form a seal between a rotary shaft and a casing of a turbomachine having a high-pressure process gas. The seal assembly may include a housing defining a bore configured to receive the rotary shaft and sealing assembly, such that the housing is coupled to or integral with the casing and includes an inboard end adjacent the casing and an outboard end distal the inboard end. The sealing assembly may also include at least one dry gas seal mounted circumferentially about the rotary shaft, and a barrier seal mounted circumferentially about the rotary shaft and adjacent the outboard end of the housing. The barrier seal may include an inboard carbon ring mounted circumferentially about the rotary shaft, an outboard carbon ring mounted circumferentially about the rotary shaft, and an intermediate carbon ring mounted circumferentially about the rotary shaft and interposed between the inboard carbon ring and the outboard carbon ring. The seal assembly may further include at least one seal gas output conduit disposed inboard of the barrier seal and configured to remove at least a portion of an injected seal gas from the housing, and a separation gas output conduit disposed between the inboard carbon ring and the intermediate carbon ring and configured to remove at least a portion of an injected separation gas from the housing, such that a seal gas pressure of the injected seal gas inboard of the inboard carbon ring is greater than the separation gas pressure of the injected separation gas between the inboard carbon ring and the intermediate carbon ring, such that the injected separation gas is prevented from flowing inboard across the inboard carbon ring and into the at least one seal gas output conduit.

Embodiments of the disclosure may further provide a sealing system for process gas leakage from a casing of a turbomachine outputting high-pressure process gas. The seal system may include a seal assembly housing coupled to or integral with the casing of the turbomachine and having an inboard end adjacent the casing and an outboard end distal the inboard end, the seal assembly housing defining a bore configured to receive a rotary shaft and a sealing assembly. The seal assembly may include a high-pressure seal mounted circumferentially about the rotary shaft proximate the inboard end of the housing, such that the high-pressure seal is configured to reduce the pressure of at least a portion of the high-pressure process gas to a first pressure lower than the high-pressure. The seal assembly may also include a high-pressure labyrinth seal mounted circumferentially about the rotary shaft and axially outward from the high-pressure seal and configured to partially restrict the flow of the process gas along the rotary shaft. The seal assembly may further include a tandem dry gas seal mounted circumferentially about the rotary shaft and axially outward from the high-pressure labyrinth seal, such that the tandem dry gas seal includes a primary dry gas seal and a secondary dry gas seal axially spaced with an intermediate labyrinth seal interposed therebetween. The seal assembly may also include a separation seal mounted circumferentially about the rotary shaft and axially outward from the tandem dry gas seal proximate the outboard end of the housing. The separation seal may include a plurality of carbon rings mounted circumferentially about the rotary shaft. The plurality of carbon rings may include an inboard carbon ring configured to prevent flow of a separation gas inboard of the barrier seal, an outboard carbon ring configured to prevent flow of contaminates into the housing, and an intermediate carbon ring interposed between the inboard carbon ring and outboard carbon ring.

Embodiments of the disclosure may further provide a method for sealing a rotary shaft of a turbomachine having a high pressure process gas. The method may include disposing the rotary shaft in a bore defined by a seal assembly housing coupled to or integral with a casing of the turbomachine, such that an inboard end of the seal assembly housing is adjacent the casing and an outboard end of the seal assembly housing is distal the casing. The method may also include mounting a barrier seal circumferentially about the rotary shaft, the barrier seal including a plurality of carbon rings including an inboard carbon ring, an outboard carbon ring, and an intermediate carbon ring interposed therebetween. The method may further include mounting at least one dry gas seal circumferentially about the rotary shaft and axially inboard from the barrier seal, and injecting a seal gas via a seal gas input conduit in fluid communication with the at least one dry gas seal, such that a first portion of the seal gas prevents a flow of the high pressure process gas across the at least one dry gas seal and a second portion of the seal gas flows outboard across the at least one dry gas seal. The method may also include injecting a separation gas via a separation gas input conduit disposed between the outboard carbon ring and the intermediate carbon ring, such that the separation gas prevents a flow of lubricant inboard across the barrier seal, and maintaining a pressure differential across the inboard carbon ring, such that the separation gas is prevented from flowing inboard across the inboard carbon ring by a residual portion of the second portion of the seal gas.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

In each of the above figures, like numerals are used to refer to like or functionally like parts among the several figures.

DETAILED DESCRIPTION

Figure 1:
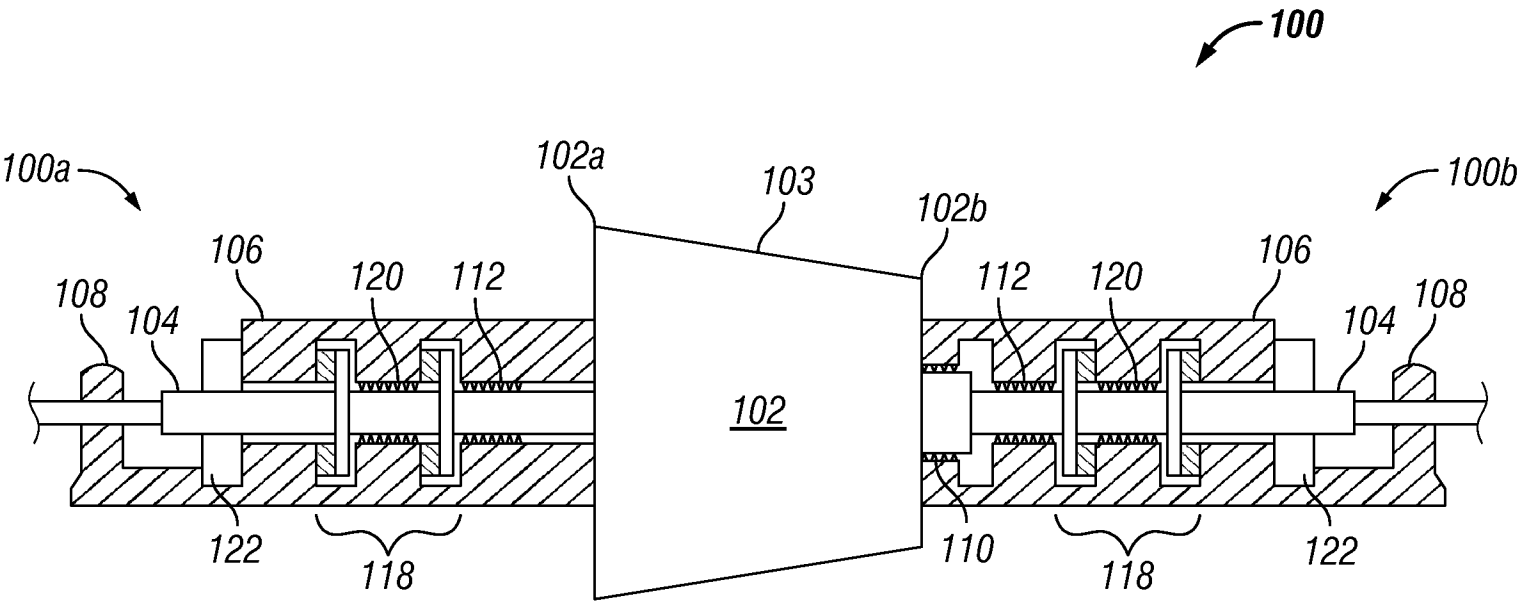
FIG. 1 illustrates a partial cross-sectional, schematic view of a centrifugal compressor utilizing an exemplary seal system, according to one or more embodiments of the present disclosure.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates an exemplary seal system 100 configured to substantially reduce or prevent process gas leakage from a turbomachine 102. The seal system 100 may include exemplary sealing assemblies 100*a,b* utilized in conjunction with the turbomachine 102. The turbomachine may be enclosed in a casing 103 or similar housing structure configured to withstand fluid pressures formed therein. In an exemplary embodiment, the turbomachine 102 may be a centrifugal compressor having a low-pressure gas entry side

102*a* and a high-pressure gas exit side 102*b*. The turbomachine 102 may also include a rotary shaft 104 configured to extend through the turbomachine 102 and exit one or both sides of the casing 103 into a seal assembly housing 106. The rotary shaft 104 may be journalled at each end by employing suitable shaft bearings 108. In alternative embodiments, the casing 103 and the seal assembly housing 106 may include the same overall structure, or otherwise, the casing 103 and the seal assembly housing 106 may each be enclosed by a separate overall casing structure.

As illustrated in FIG. 1, the seal assembly 100*a* may be installed on the low-pressure gas entry side 102*a*, and the other seal assembly 100*b* may be installed on the high-pressure gas exit side 102*b*. In alternative embodiments, however, the exemplary seal system 100 as discussed herein may be utilized effectively on a single sided turbomachine (e.g., machines of the overhang type). It will be understood by one of ordinary skill in the art that the seal system 100 to be installed will be a design choice, which may depend at least upon the turbomachine configuration.

Relative to the housing 106, the rotary shaft 104 may be sealed via a series of seals to substantially reduce or prevent process gas leakage from the internal portion of the turbomachine 102 enclosed in the casing 103. In particular, in an exemplary embodiment, the turbomachine 102 utilizes the seal assemblies 100*a,b*, both being configured to substantially reduce or prevent process gas from escaping the turbomachine casing 103 and seal assembly housing 106 and entering the atmosphere. For example, in certain operations involving the processing of toxic or explosive gas under pressure, in either on-shore or off-shore environments, the seal assemblies 100*a,b* may be designed to prevent such gas from leaking to the external environment, thereby avoiding undesired reactions or harmful exposure to personnel.

In an exemplary embodiment, the seal assembly 100*b* on the gas exit side 102*b* may include a high-pressure labyrinth seal 112, a tandem dry gas seal 118 including an intermediate labyrinth seal 120, and a separation (barrier) seal 122. In addition, the seal assembly 100*b* may include a high-pressure seal 110. Each seal (collectively 110, 112, 118, 120, and 122) may be mounted and extend circumferentially about the rotary shaft 104 and be sequentially mounted outboard, i.e., axially outward relative to the turbomachine casing 103, as depicted in FIG. 1. The seal assembly 100*a* on the gas entry side 102*a* may have similar components as the seal assembly 100*b* on the gas exit side 102*b*, excepting the high-pressure seal 110.

Figure 2:
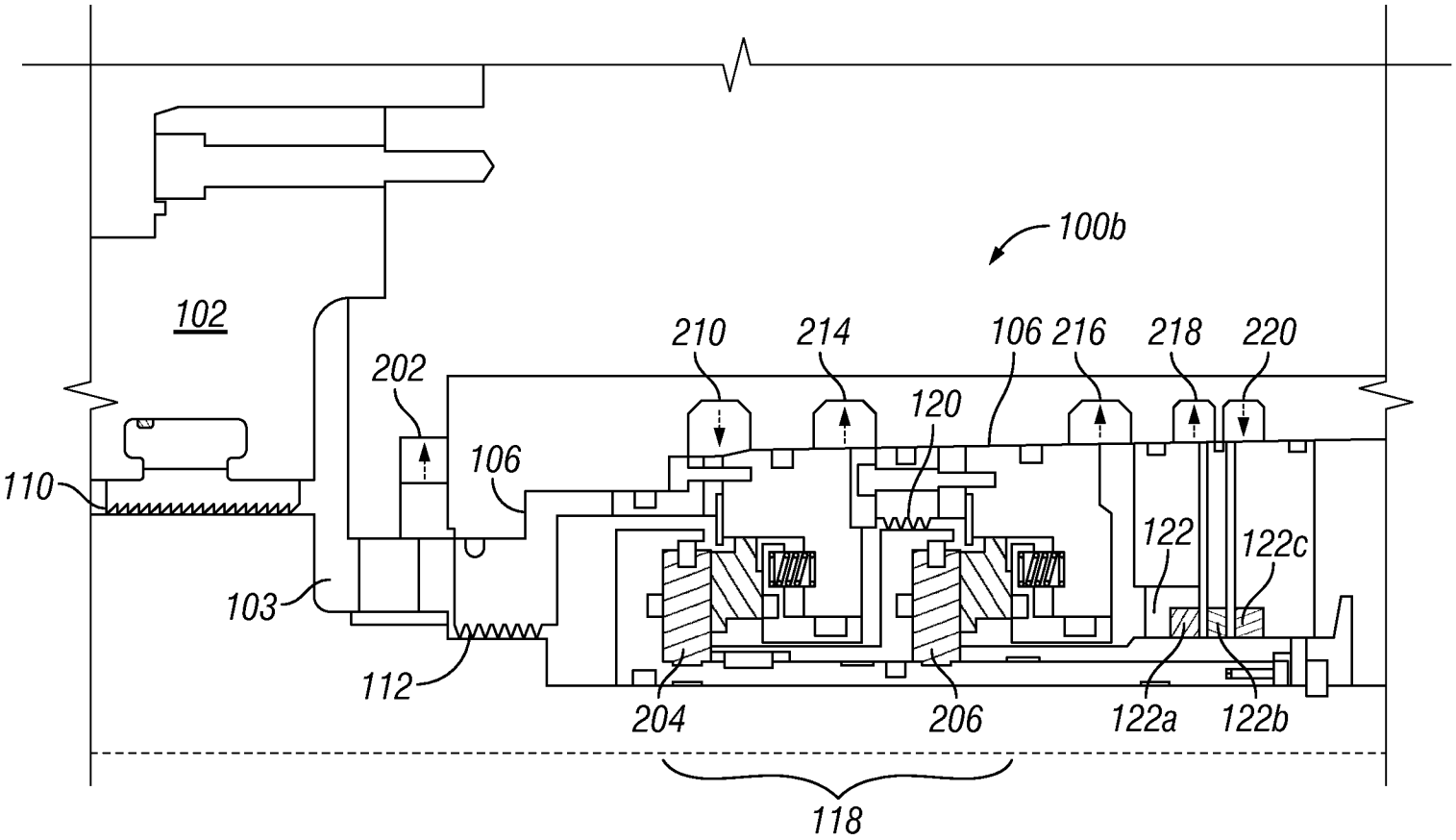
FIG. 2 illustrates a partial cross-sectional view of a gas side exit of a centrifugal compressor utilizing an exemplary seal system, according to one or more embodiments of the present disclosure.

Referring now to FIG. 2, illustrated is an exemplary embodiment of the sealing assembly 100*b* in conjunction with the gas exit side 102*b* of the turbomachine 102. As illustrated, the high-pressure seal 110 may be situated on the high-pressure gas exit side 102*b* of the turbomachine 102, and radially coupled to an outer edge of the interior portion of the turbomachine casing 103. The high-pressure seal 110 may be used to reduce the pressure of any process gas escaping the casing 103 to a lower inner-stage pressure. This may be done to create a delta pressure that serves to balance axial thrust forces generated inside the turbomachine 102 in the case of a straight through-type centrifugal compressor. In one embodiment, a portion of this reduced-pressure process gas may be collected via inboard conduit 202 and re-injected (see FIG. 3) at gas entry side 102*a* to be re-pressurized by the turbomachine 102. The high-pressure labyrinth seal 112, located coaxially adjacent and axially outboard of the high-pressure seal 110, may be configured to separate any escaping process gas from the high-pressure seal 110.

Still referring to FIG. 2, the tandem dry gas seal 118 may be located coaxially adjacent and axially outboard of the high-pressure labyrinth seal 112. In an exemplary embodiment, the tandem dry gas face seal 118 may include a primary dry gas seal 204 and a secondary dry gas seal 206 with an intermediate labyrinth seal 120 interposed therebetween. The intermediate labyrinth seal 120 may be provided to further reduce or prevent leakage across the primary dry gas seal 204 outboard and across the secondary dry gas seal 206. Further, the barrier seal 122 may be located coaxially adjacent and axially outboard of the secondary dry gas seal 206 and may further include three carbon rings 122*a*,122*b*, 122*c*, which will be discussed in greater detail below.

As will be understood by one of ordinary skill in the art, during typical operation of a dry gas seal, a portion of the high-pressure process gas may be sourced from the turbomachine. Before the process gas is introduced to the dry gas seal to help maintain a high-pressure sealing effect and/or prevent potential contamination of the seals, the process gas may be cleaned or filtered via one or more methods known to those of ordinary skill in the art. Prior to cleaning, this process gas may contain foreign matter such as dirt, iron filings, and other solid particles which can contaminate the seals. Therefore, cleaned seal gas, including filtered process gas or an inert gas from an external source, may be injected at one or more dry gas seals at a predetermined pressure higher than the pressures in the preceding inner-areas of the seal assembly housing in order to block process gas leakage. In operation, the cleaned seal gas may be pressurized by a small reciprocating compressor, or may utilize pressurized gas from an alternative turbomachine application.

In exemplary operation of the present disclosure, a portion of cleaned seal gas may be injected via a seal gas input conduit 210, at a pressure in excess of the process gas leakage inboard of the high-pressure labyrinth seal 112. In an exemplary embodiment, the cleaned seal gas is sourced from the discharge line of the turbomachine 102. The resulting pressure differential may impede the exit of the high-pressure, potentially hazardous process gas leakage outboard across the high-pressure labyrinth seal 112, and instead, may provide for a first portion of the clean seal gas to flow inboard across the high-pressure labyrinth seal 112, such that the process gas leakage and the first portion of the cleaned seal gas are routed from the seal assembly housing 106 via inboard conduit 202 to be re-injected into the process stream, possibly at the low-pressure gas entry side 102*a* (seen most clearly in FIG. 3). The remaining clean seal gas, or the second portion, may flow outboard across the primary dry gas seal 204, such that a main portion of the second portion of the seal gas may be collected via primary vent 214 or secondary vent 216 for recycling into the process stream, disposal by flaring, or use in alternative applications. For example, the collected main portion may be re-directed to a separate turbomachine 222, or other system or device, to be further processed to higher pressures (seen most clearly in FIG. 3).

As described above, the main portion of the remaining clean seal gas flowing through the primary dry gas seal 204 may be collected via one or more seal gas output conduits, illustrated as the primary vent 214 and the secondary vent 216. In an exemplary embodiment, a majority of the main portion of the remaining clean seal gas may be collected via the primary vent 214; however, the remaining portion of the main portion of the clean seal gas may flow across the intermediate labyrinth seal 120 and secondary dry gas seal 206 as leakage. A majority of the seal gas leakage across the secondary dry gas seal 206 may either be collected or discharged to flare via the tandem secondary vent 216; however, as discussed below, a residual portion of the leakage across the secondary dry gas seal 206 may bypass the secondary vent 216, thereby providing in part a pressure differential at the barrier seal 122.

In an exemplary embodiment, the primary dry gas seal 204 may be configured to absorb the full pressure drop between the seal gas input conduit 210 and the secondary vent 216. In an embodiment, the primary dry gas seal 204 absorbs the total pressure drop to the turbomachine 102 vent system, and the secondary dry gas seal 206 serves as a backup to allow safe shutdown of the turbomachine 102 in the event of the primary dry gas seal 204 failure. In other words, in an embodiment, as long as the leakage through the primary dry gas seal 204 is minimal, the secondary dry gas seal 206 may operate on idle since it only has to overcome a small pressure difference.

In an exemplary embodiment, separation gas, such as nitrogen or air, may be injected into the separation (barrier) seal 122 via separation gas input conduit 220. Injecting separation gas into the barrier seal 122 may prevent the further migration of any escaping clean seal gas into the shaft bearings 108 and also may prevent lubrication oil from contaminating the dry gas seals 204,206. In an exemplary embodiment, the barrier seal 122 may be a bushing-type carbon ring barrier seal including three carbon rings 122*a*, 122*b*,122*c*.

As illustrated in FIG. 2, the three carbon rings of the barrier seal 122 include an inboard carbon ring 122*a*, an outboard carbon ring 122*c* and an intermediate carbon ring 122*b* interposed therebetween. The carbon rings are mounted and disposed about the rotary shaft 104 such that the separation gas may be introduced via the separation gas input conduit 220 between the outboard carbon ring 122*c* and the intermediate carbon ring 122*b*. In exemplary operation of the present disclosure, the separation gas may be injected via separation gas input conduit 220 at a pressure in excess of the pressure proximate the shaft bearings 108. The resulting pressure differential may prohibit the lubrication from the shaft bearings 108 from entering the barrier seal 122, and may further force a majority of the separation gas across outboard carbon ring 122*c* to flow to the atmosphere as an environmentally-harmless discharge. In one or more embodiments, a residual portion of the separation gas may leak inboard across the intermediate carbon ring 122*b* and may be collected via a separation gas output conduit, illustrated as separation vent 218. As shown in FIG. 2, the separation vent 218 may be disposed between the inboard carbon ring 122*a* and intermediate carbon ring 122*b*.

Moreover, in an exemplary embodiment, the injection pressure of the separation gas, although greater than the pressure proximate the shaft bearings 108, may be monitored to ensure that the pressure of the separation gas leaked inboard across the intermediate carbon ring 122*b* and collecting between the intermediate carbon ring 122*b* and inboard carbon ring 122*a* is retained at a pressure less than the pressure of the clean seal gas on the opposing side of the inboard carbon ring 122*a*, such that separation gas is prevented from flowing inboard across the inboard carbon ring 122*a*. Such monitoring may be accomplished by one or more pressure or flow rate sensors or any other device and/or method known to those of ordinary skill in the art.

Accordingly, in addition to the residual leakage of the separation gas inboard across the intermediate carbon ring 122*b*, the separation vent may also receive a residual portion of the clean seal gas bypassing the secondary vent 216 and leaking outboard across the inboard carbon ring 122*a* of the barrier seal 122 due to the maintained pressure differential across the inboard carbon ring 122*a*. In one or more embodiments, the separation vent may be fluidly coupled to a gas separator configured to separate the seal gas from the inert gas, thereby avoiding discharge of the seal gas including process gas to the atmosphere.

Figure 3:
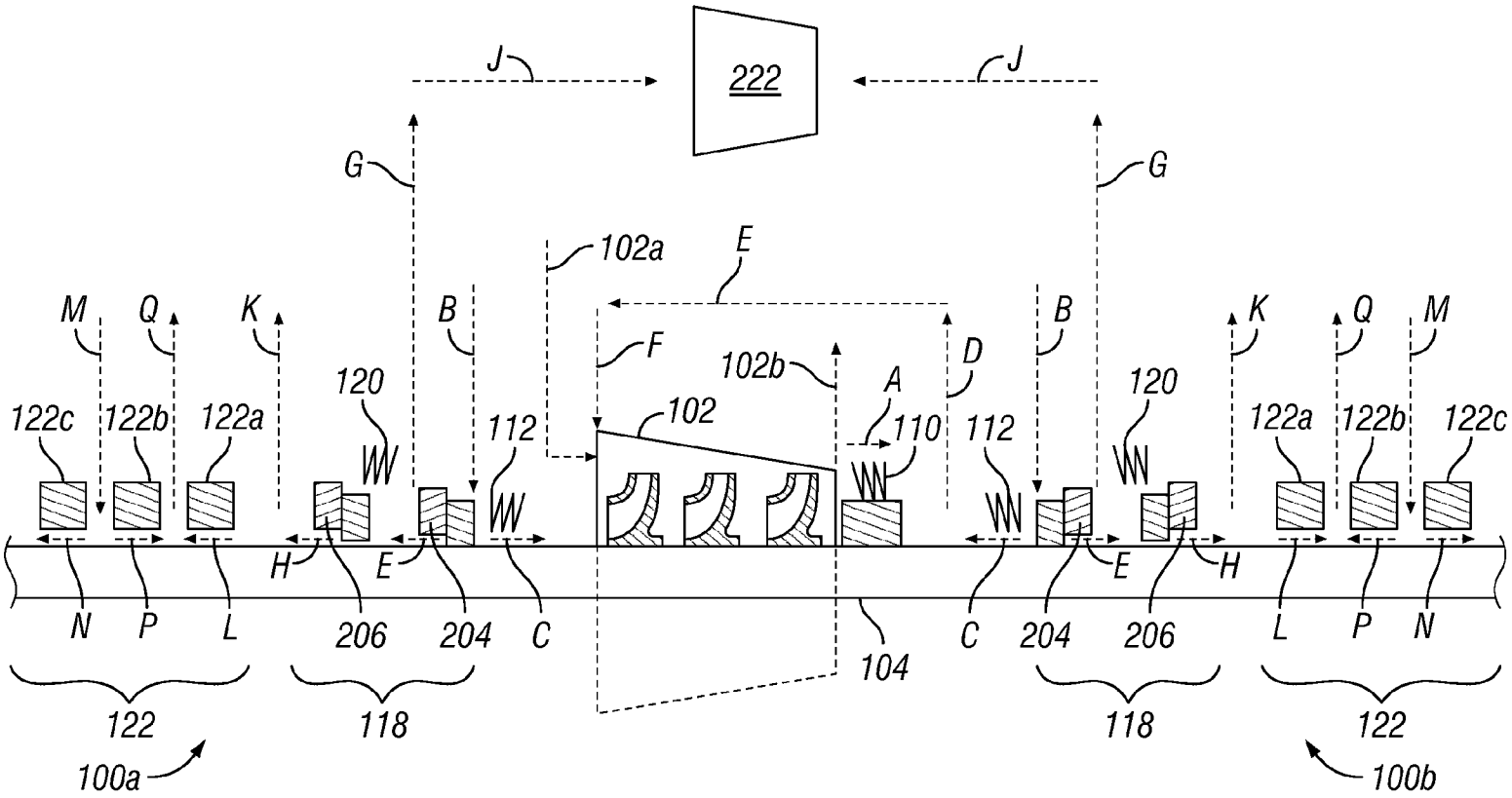
FIG. 3 illustrates a schematic view of the centrifugal compressor and exemplary seal system illustrated in FIG. 2.

As further explanation of the foregoing sealing assembly 100*b*, the following exemplary embodiment of operation is given. The following pressures are provided as exemplary pressures and are intended to non-limiting, as actual pressures may vary based, at least, on the process gas provided and the performance parameters of the turbomachine. Referring to FIG. 3 in conjunction with FIG. 2 to assist in the explanation of the foregoing sealing assembly 100*b*, a process gas may be introduced into the turbomachine 102 at input 102*a*, wherein the turbomachine 102 may be configured to compress the process gas to a high pressure, reaching approximately 2328.4 kPa (approx. 323 psig). Once compressed, the process gas may subsequently be discharge via output 102*b*. While the bulk of the compressed gas is properly discharged via output 102*b*, a small portion of the process gas at a pressure of about 2328.4 kPa (approx. 323 psig) may leak out through minute gaps between the rotary shaft 104 and the turbomachine 102.

As illustrated in FIG. 3, the rotary shaft 104 may be sealed via at least one sealing assembly 100*a,b* configured to prevent process gas effusion from the inner portion of the turbomachine 102 to the atmosphere. A high-pressure seal 110, adjacent the turbomachine 102 on the gas output side 102*b*, may be configured to reduce the pressure to an inner-stage pressure of approximately 228.2 kPa (approx. 18.4 psig). In particular, as shown at arrow A, the high-pressure seal 110 may reduce the leakage pressure out of the turbomachine 102 from about 2328.4 kPa (approx. 323 psig) to about 228.2 kPa (approx. 18.4 psig).

To prevent further process gas leakage, a seal gas may then be injected at arrow B via the seal gas input conduit 210 (see FIG. 2) between the high-pressure labyrinth seal 112 and the primary dry gas seal 204. The seal gas, including at least a portion of clean process gas, may be injected at a pressure slightly greater than about 297.2 kPa (approx. 28.4 psig). Since the injection pressure of the seal gas at arrow B is greater than the reduced pressure resulting from the high-pressure seal 110, the seal gas may act to prevent leakage outboard across the high-pressure labyrinth seal 112, and instead may force a first portion of the injected seal gas inboard across the high-pressure labyrinth seal 112, as shown by arrow C. At a pressure of approximately 228.2 kPa (approx. 18.4 psig), the combined mixture of process gas leakage and seal gas may then be re-directed, as shown by arrows D, E, and F, via inboard conduit 202 (see FIG. 2) and directly re-introduced at input 102*a* into the turbomachine 102 for re-processing.

In operation, however, a second portion of the injected seal gas may flow across the primary dry gas seal 204 as leakage, indicated by arrow E. In an exemplary embodiment, the primary dry gas seal 204 may be designed to absorb the full pressure injected at arrow B. In other words, the primary dry gas seal 204 may be configured to seal a pressure of about 297.2 kPa (approx. 28.4 psig). The secondary dry gas seal 206, therefore, in an embodiment, may act as a backup in the event of the primary dry gas seal 204 failure.

As shown in FIG. 3, a portion of the second portion E of the seal gas flowing across the primary dry gas seal 204 as leakage may be directed through the primary vent 214 (see FIG. 2), as indicated by arrow G, and routed via conduit J to a separate, higher-pressure, turbo machine 222 application. In other embodiments, the leakage G routed through the primary vent 214 of the gas exit side 102*b* may be recycled to gas entry side 102*a* for re-processing, or the leakage G may be routed to a flare for disposal. A remaining portion of the second portion E of the seal gas may flow in an outboard direction across the intermediate labyrinth seal 120 and the secondary dry gas seal 206, as indicated by arrow H. As the remaining portion H flows across the intermediate labyrinth seal 120 and the secondary dry gas seal 206, a pressure drop occurs, such that the remaining portion H is reduced to a pressure of about 142.7 kPa (approx. 6 psig). A majority of the remaining portion H is directed through the secondary vent 216 (see FIG. 2), as indicated by arrow K.

Although the majority of remaining portion H of the second portion E is directed into the secondary vent 216, as indicated by arrow K, a residual portion, indicated by arrow L, may flow across a portion of the barrier seal 122, and in particular, inboard carbon ring 122*a* due to the pressure differential across the inboard carbon ring 122*a*. A separation gas may be injected via separation gas input conduit 218 (see FIG. 2), as indicated by arrow M, between the outboard carbon ring 122*c* and the intermediate carbon ring 122*b* at a pressure of about 139.3 kPa (approx. 5.5 psig). Since the injected separation gas is at a higher pressure than the pressure proximate the shaft bearings 108 (see FIG. 1), a substantial portion of the separation gas may flow outboard across the outboard carbon ring 122*c* toward the shaft bearings 108, where it may be harmlessly discharged to the atmosphere, as indicated by arrow N; however, a residual portion of the separation gas, as indicated by arrow P, may flow across the intermediate carbon ring 122*b*.

The injected pressure of the separation gas at arrow M may be based not only on the pressure proximate the shaft bearings 108, but may also be based on the pressure of the residual portion of seal gas, indicated by arrow L, leaking outboard across the inboard carbon ring 122*a* of the barrier seal 122. The injected pressure of the separation gas at arrow M may allow for the pressure of the separation gas after undergoing a pressure drop inboard across the intermediate carbon ring 122*b* to be less than the pressure of the residual portion of seal gas, indicated by arrow L, leaking outboard across the inboard carbon ring 122*a* of the barrier seal 122. This pressure differential prevents the separation gas from flowing inboard across the inboard carbon ring 122*a* and into the secondary vent 216. Accordingly, in an exemplary embodiment, the secondary vent 216 will only receive therethrough the seal gas leakage across the secondary dry gas seal 206, thereby allowing for the discharge of only seal gas, as indicated by arrow K, back into the process stream on the low-pressure gas entry side 102*a*, to a separate, higher-pressure, turbomachine 222 application, or out to flare for disposal. The residual seal gas flowing outboard across the inner carbon ring 122*a* and the residual separation gas flowing inboard through the intermediate carbon ring 122*b* may be directed through the separation vent 218, as indicated by arrow Q, at a pressure of about 104.8 kPa (approx. 0.5 psig).

Figure 4:
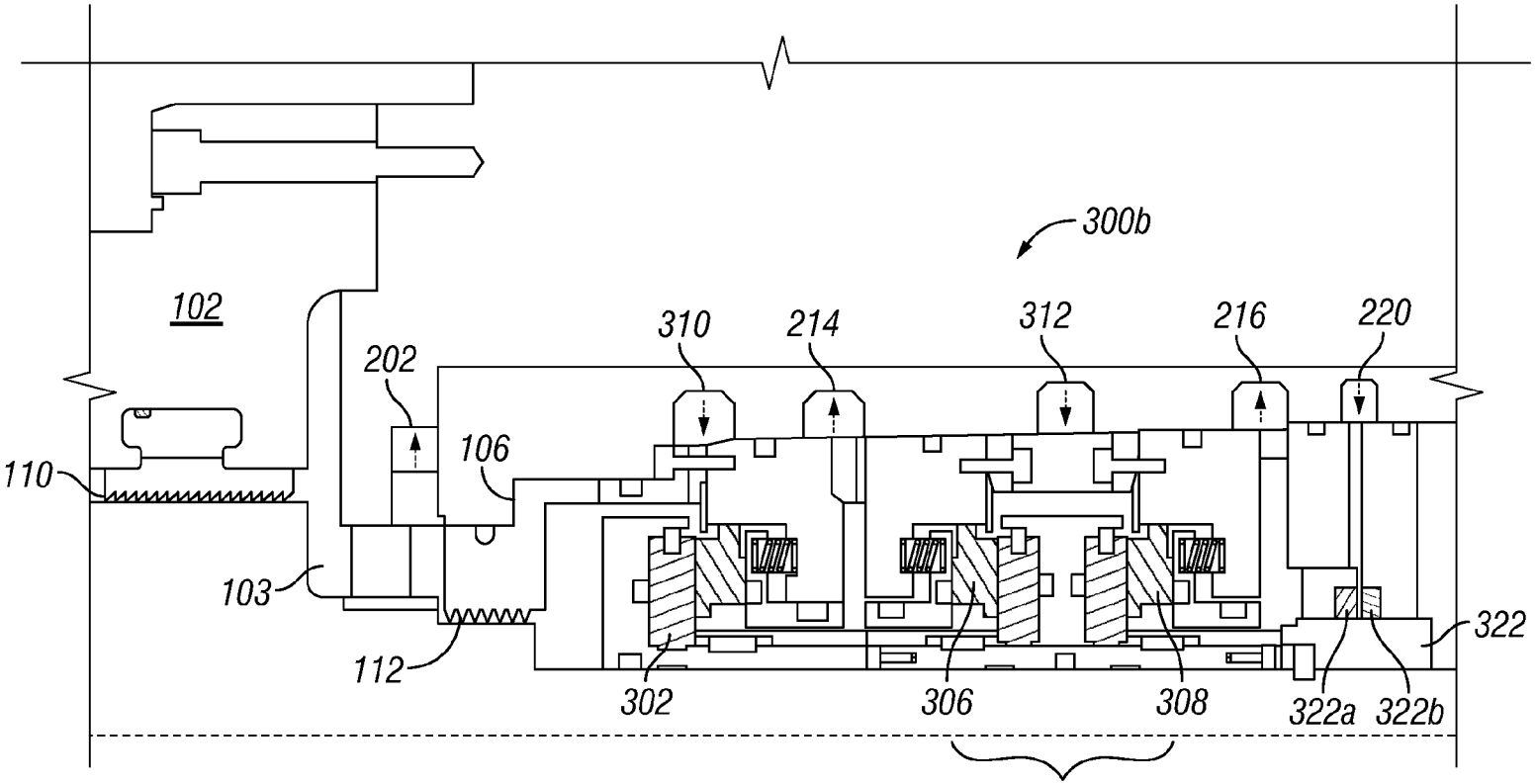
FIG. 4 illustrates a partial cross-sectional view of the gas side exit of the centrifugal compressor utilizing another exemplary seal system, according to one or more embodiments of the present disclosure.

In FIG. 4, illustrated is another sealing assembly 300*b*, according to one or more embodiments disclosed. The sealing assembly 300*b* may be similar in some respects to the sealing assembly 100*b* of FIGS. 1-3, where like numerals designate like components and will not be described again in detail. As illustrated, the sealing assembly 300*b* may be utilized in conjunction with the gas exit side 102*b* of the turbomachine 102. As illustrated, the high-pressure seal 110 may be situated on the high-pressure gas exit side 102*b* of the turbomachine 102, and radially coupled to an outer edge of the interior of the turbomachine casing 103. The high-pressure seal 110 may be used to reduce the pressure of any process gas escaping the casing 103 to a lower inner-stage pressure. The high-pressure labyrinth seal 112, located coaxially adjacent to the high-pressure seal 110, may be configured to separate any escaping process gas from the high-pressure seal 110.

In the exemplary embodiment illustrated in FIG. 4, the seal assembly 300*b* includes the combination of a single dry gas seal 302, located coaxially adjacent and axially outboard of the high-pressure labyrinth seal 112, and a double opposed dry gas seal 304, which may be located coaxially adjacent and axially outboard of the single dry gas seal 302. In an exemplary embodiment, the double opposed dry gas seal 304 may include a first dry gas seal 306 and a second dry gas seal 308 operating in parallel, in a back-to-back configuration. Further, the barrier seal 322 may be located coaxially adjacent and axially outboard of the second dry gas seal 308 and may further include two carbon rings 322*a*, 322*b*.

In exemplary operation of the present disclosure, a portion of cleaned seal gas may be injected via a first seal gas input conduit 310 at a pressure in excess of the process gas leakage inboard of the high-pressure labyrinth seal 112. In an exemplary embodiment, a clean seal gas including at least a portion of cleaned or filtered process gas may be injected into the first seal gas input conduit 310. In an exemplary embodiment, the cleaned seal gas is sourced from the discharge line of the turbomachine 102. The resulting pressure differential may impede the exit of the high-pressure, potentially hazardous process gas leakage outboard across the high-pressure labyrinth seal 112, and instead, may provide for a first portion of the clean seal gas to flow inboard across the high-pressure labyrinth seal 112, such that the process gas leakage and the first portion of the cleaned seal gas are routed from the seal assembly housing 106 via inboard conduit 202 to be re-injected into the process stream, possibly at the low-pressure gas entry side 102*a* (seen most clearly in FIG. 3). The remaining clean seal gas, or second portion, may flow outboard across the single dry gas seal 302, thereby being collected via the primary vent 214.

As shown in FIG. 4, another portion of clean seal gas may be injected into a second seal gas input conduit 312 disposed between the first and second dry gas seals 306,308. In an exemplary embodiment, an inert seal gas may be injected into the second seal gas input conduit 312. The inert seal gas may be injected at a pressure in excess of the pressure proximate the inboard side of the first dry gas seal 306, thereby preventing the clean seal gas injected into the first seal gas input conduit 310 from bypassing the primary vent 214 and flowing outboard across the first dry gas seal 306. Accordingly, the primary vent 214 may be configured to route, from the seal assembly housing 106, a mixture of the clean seal gas including at least a portion of clean or filtered process gas and a first portion of the inert seal gas.

In an exemplary embodiment, a second portion of the inert seal gas may flow outboard through the second dry gas seal 308. A separation gas, such as nitrogen or air, may be injected into the separation (barrier) seal 322 via separation gas input conduit 220. Injecting separation gas into the barrier seal 322 may prevent the further migration of any escaping inert seal gas into the shaft bearings 108 and also may prevent lubrication oil from contaminating the dry gas seals 302,306,308. In an exemplary embodiment, the barrier seal 322 may be a bushing-type carbon ring barrier seal including two carbon rings 322*a*,322*b*.

As illustrated in FIG. 4, the two carbon rings of the barrier seal 322 include an inboard carbon ring 322*a* and an outboard carbon ring 322*b*. The carbon rings are mounted and disposed about the rotary shaft 104 such that the separation gas may be introduced via the separation gas input conduit 220 therebetween. In exemplary operation of the present disclosure, the separation gas may be injected via separation gas input conduit 220 at a pressure in excess of the pressure proximate the shaft bearings 108. The resulting pressure differential may prohibit the lubrication from the shaft bearings 108 from entering the barrier seal 322, and may further force a majority of the separation gas across outboard carbon ring 322*b* to flow to the atmosphere as an environmentally-harmless discharge. In one or more embodiments, a residual portion of the separation gas may leak inboard across the inboard carbon ring 322*a* and may be collected via the secondary vent 216. As shown in FIG. 4, the secondary vent 216 may be disposed between the inboard carbon ring 322*a* and second dry gas seal 308.

Moreover, in an exemplary embodiment, the injection pressure of the separation gas, although greater than the pressure proximate the shaft bearings 108, may be monitored to ensure that the pressure of the separation gas leaked inboard across the inboard carbon ring 322*a* is retained at a pressure higher than the pressure of the inert seal gas on the opposing side of the inboard carbon ring 322*a*, such that inert seal gas is prevented from flowing outboard across the inboard carbon ring 322*a*. Such monitoring may be accomplished by one or more pressure or flow rate sensors or any other devices and/or methods known to those of ordinary skill in the art.

Accordingly, in addition to the residual leakage of the separation gas inboard across the inboard carbon ring 322*a*, the secondary vent 216 may also receive a residual portion of the inert seal gas leaking outboard across the second dry gas seal 308. In one or more embodiments, the secondary vent 216 may discharge the inert gas of the separation gas and the inert seal gas to the atmosphere.

Figure 5:
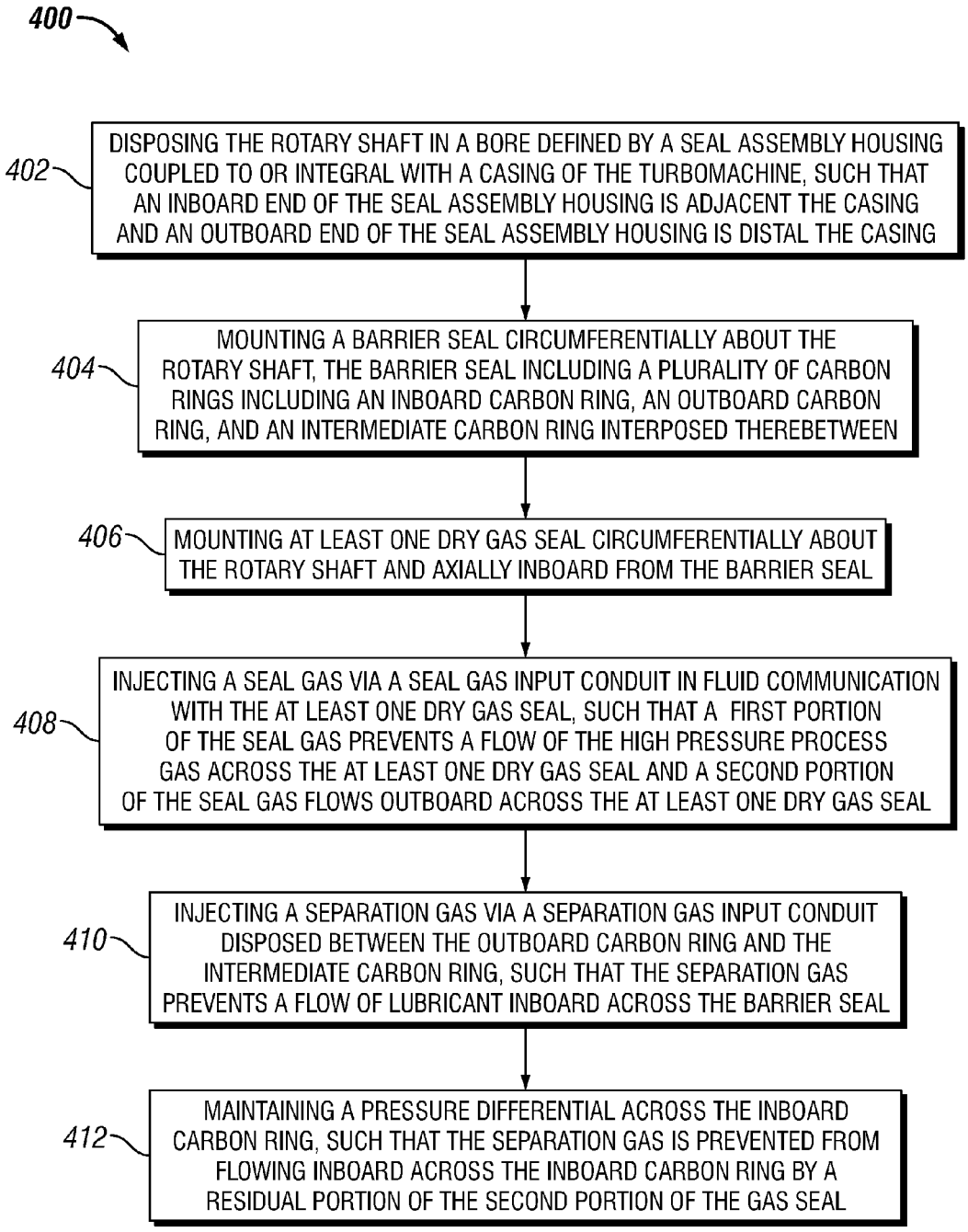
FIG. 5 is a flowchart illustrating a method for sealing a rotary shaft of a turbomachine having a high pressure process gas.

FIG. 5 is a flowchart illustrating a method 400 for sealing a rotary shaft of a turbomachine having a high pressure process gas. In an exemplary embodiment, the method 400 may include disposing the rotary shaft in a bore defined by a seal assembly housing coupled to or integral with a casing of the turbomachine, such that an inboard end of the seal assembly housing is adjacent the casing and an outboard end of the seal assembly housing is distal the casing, as shown at 402. The method 400 may also include mounting a barrier seal circumferentially about the rotary shaft, the barrier seal including a plurality of carbon rings including an inboard carbon ring, an outboard carbon ring, and an intermediate carbon ring interposed therebetween, as shown at 404.

The method 400 may further include mounting at least one dry gas seal circumferentially about the rotary shaft and axially inboard from the barrier seal, as shown at 406. The method 400 may also include injecting a seal gas via a seal gas input conduit in fluid communication with the at least one dry gas seal, such that a first portion of the seal gas prevents a flow of the high pressure process gas across the at least one dry gas seal and a second portion of the seal gas flows across the at least one dry gas seal, as shown at 408. The method 400 may further include injecting a separation gas via a separation gas input conduit disposed between the outboard carbon ring and the intermediate carbon ring, such that the separation gas prevents a flow of lubricant inboard across the barrier seal, as shown at 410. The method 400 may also include maintaining a pressure differential across the inboard carbon ring, such that the separation gas is prevented from flowing inboard across the inboard carbon ring by a residual portion of the second portion of the seal gas, as shown at 412.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A sealing assembly configured to form a seal between a rotary shaft and a casing of a turbomachine having a high-pressure process gas, comprising:

a housing defining a bore configured to receive the rotary shaft and sealing assembly, wherein the housing is coupled to or integral with the casing and comprises an inboard end adjacent the casing and an outboard end distal the inboard end;

at least one dry gas seal mounted circumferentially about the rotary shaft;

a barrier seal mounted circumferentially about the rotary shaft and adjacent the outboard end of the housing, the barrier seal comprising:

an inboard carbon ring mounted circumferentially about the rotary shaft;

an outboard carbon ring mounted circumferentially about the rotary shaft; and an intermediate carbon ring mounted circumferentially about the rotary shaft and interposed between the inboard carbon ring and the outboard carbon ring;

at least one seal gas output conduit disposed inboard of the barrier seal and defining a fluid passageway through which at least a portion of an injected seal gas is removed from the housing; and a separation gas output conduit disposed between the inboard carbon ring and the intermediate carbon ring and defining a first fluid pathway through which at least a portion of an injected separation gas is removed from the housing, wherein a seal gas pressure of the injected seal gas inboard of the inboard carbon ring is greater than the separation gas pressure of the injected separation gas between the inboard carbon ring and the intermediate carbon ring, such that the injected separation gas is prevented from flowing inboard across the inboard carbon ring and into the at least one seal gas output conduit.

2. The sealing assembly of claim 1, wherein the at least one dry gas seal comprises a tandem dry gas seal comprising a primary dry gas seal and a secondary dry gas seal.

3. The sealing assembly of claim 2, wherein the at least one seal gas output conduit comprises:

a first seal gas output conduit disposed between the primary dry gas seal and the secondary dry gas seal; and a second seal gas output conduit disposed between the secondary dry gas seal and the barrier seal, wherein each of the first seal gas output conduit and the second seal gas output conduit defines a respective fluid passageway through which a main portion of a second portion of the injected seal gas is removed from the housing.

4. The sealing assembly of claim 1, further comprising a separation gas input conduit disposed between the outboard carbon ring and the intermediate carbon ring and defining a second fluid pathway through which the injected separation gas is injected into the housing.

5. The sealing assembly of claim 1, further comprising a first labyrinth seal mounted circumferentially about the rotary shaft and disposed inboard of the at least one dry gas seal.

6. The sealing assembly of claim 5, further comprising a seal gas input conduit disposed between the first labyrinth seal and the at least one dry gas seal and configured to provide the injected seal gas to the at least one dry gas seal.

7. The sealing assembly of claim 1, wherein the injected seal gas comprises at least a portion of the high-pressure process gas from the turbomachine.

8. The sealing assembly of claim 1, further comprising a high-pressure seal mounted circumferentially about the rotary shaft and disposed axially inboard of the first labyrinth seal and axially adjacent the casing.

9. The sealing assembly of claim 8, wherein the at least one seal gas output conduit comprises a first seal gas output conduit disposed between the high-pressure seal and the first labyrinth seal and defining a fluid passageway through which a first portion of the injected seal gas and a portion of a process gas leakage is removed from the housing.

10. The sealing assembly of claim 9, wherein the first seal gas output conduit is fluidly coupled to a gas entrance side of the turbomachine.

11. A sealing system for process gas leakage from a casing of a turbomachine outputting high-pressure process gas, comprising:

a seal assembly housing coupled to or integral with the casing of the turbomachine and having an inboard end adjacent the casing and an outboard end distal the inboard end, the seal assembly housing defining a bore configured to receive a rotary shaft and a sealing assembly, the seal assembly comprising:

a high-pressure seal mounted circumferentially about the rotary shaft proximate the inboard end of the housing, wherein the high-pressure seal is configured to reduce the pressure of at least a portion of the high-pressure process gas to a first pressure lower than the high-pressure;

a high-pressure labyrinth seal mounted circumferentially about the rotary shaft and axially outward from the high-pressure seal and configured to partially restrict the flow of the process gas along the rotary shaft;

a tandem dry gas seal mounted circumferentially about the rotary shaft and axially outward from the high-pressure labyrinth seal, wherein the tandem dry gas seal comprises a primary dry gas seal and a secondary dry gas seal axially spaced with an intermediate labyrinth seal interposed therebetween; and a separation seal mounted circumferentially about the rotary shaft and axially outward from the tandem dry gas seal proximate the outboard end of the housing, the separation seal comprising:

a plurality of carbon rings mounted circumferentially about the rotary shaft, comprising:

an inboard carbon ring configured to prevent flow of a separation gas inboard of the barrier seal;

an outboard carbon ring configured to prevent flow of contaminates into the housing; and an intermediate carbon ring interposed between the inboard carbon ring and outboard carbon ring.

12. The sealing system of claim 11, further comprising:

a seal gas input conduit disposed between the high-pressure labyrinth seal and the tandem dry gas seal and configured to provide a seal gas to the primary dry gas seal;

a first seal gas output conduit disposed between the primary dry gas seal and the secondary dry gas seal; and a second seal gas output conduit disposed between the secondary dry gas seal and the barrier seal, wherein each of the first seal gas output conduit and the second seal gas output conduit defines a respective fluid passageway through which a main portion of a second portion of the injected seal gas is removed from the seal assembly housing.

13. The sealing system of claim 12, further comprising:

a separation gas input conduit disposed between the outboard carbon ring and the intermediate carbon ring and defining a first fluid pathway through which the separation gas is injected into the housing; and a separation gas output conduit disposed between the inboard carbon ring and the intermediate carbon ring and defining a second fluid pathway through which at least a portion of an injected separation gas is removed from the housing, wherein a seal gas pressure of the seal gas inboard of the inboard carbon ring is greater than the separation gas pressure of the separation gas between the inboard carbon ring and the intermediate carbon ring, such that the separation gas is prevented from flowing inboard across the inboard carbon ring and into the second seal gas output conduit.

* * * * *